US005979810A

United States Patent [19]

Barth

[11] Patent Number: 5,979,810

[45] Date of Patent: Nov. 9, 1999

[54] TENSION DEVICE

[75] Inventor: Peter Barth, Bodelshausen, Germany

[73] Assignee: Barth-Tex Instruments & Software GmbH & Co., Germany

[21] Appl. No.: 09/029,503

[22] PCT Filed: Jul. 24, 1996

[86] PCT No.: PCT/EP96/03262

§ 371 Date: Mar. 30, 1998

§ 102(e) Date: Mar. 30, 1998

[87] PCT Pub. No.: WO97/08090

PCT Pub. Date: Mar. 6, 1997

[30] Foreign Application Priority Data

Aug. 28, 1995 [DE] Germany ..... 195 31 579

[51] Int. Cl.[6] ..... B65H 59/22

[52] U.S. Cl. ..... 242/150 M

[58] Field of Search ..... 242/147 M, 150 M

[56] References Cited

U.S. PATENT DOCUMENTS

| | | | |
|---|---|---|---|
| 2,614,773 | 10/1952 | Ammerall | 242/150 M |
| 2,650,043 | 8/1953 | Grein . | |
| 3,001,946 | 9/1961 | Jentschmann | 242/150 M |
| 4,462,557 | 7/1984 | Warner | 242/150 M |
| 5,294,071 | 3/1994 | Hartel et al. | 242/150 M |
| 5,301,895 | 4/1994 | Sheehan et al. | 242/150 M |
| 5,782,424 | 7/1998 | Horvath et al. | 242/365.6 X |

FOREIGN PATENT DOCUMENTS

| | | |
|---|---|---|
| 864073 | 1/1953 | Germany . |
| 1070531 | 12/1959 | Germany . |
| 2000268 | 7/1971 | Germany . |
| 43 01 507 | 8/1994 | Germany . |
| 44 09 450 | 9/1995 | Germany . |
| 850858 | 10/1960 | United Kingdom . |

*Primary Examiner*—Michael R. Mansen

[57] ABSTRACT

A tension device with two preferably disc- or plate-shaped brake elements forced against one another by load devices and between which at least one thread to be braked can be led through. The brake elements are mounted on a bearing of a common bearing axle and capable of rotating freely about the bearing axle. The tension devise is provided with at least one magnetic loading device mounted on one of the two brake elements and at least one other magnetic loading device separate from the brake element with the magnetic loading device by which the brake elements are forced axially against one another.

15 Claims, 2 Drawing Sheets

TENSION DEVICE

BACKGROUND OF THE INVENTION

1. Field of the Invention

The invention relates to a yarn brake with two preferably disc-shaped or plate-shaped brake elements pressed resiliently against one another by magnetic loading.

2. Discussion of the Relevant Art

Yarn brakes of this type are used to a great extent for imparting yarn tension to running yarns on textile machines and are known, for example, from EP 499 218 A2, DE-A 20 00 268, DE-C 864 073, GB-A 850,858 or DE 43 01 507 A1.

These publications propose a yarn brake, in which the brake plates are induced to clamp or brake the yarn by means of opposite-pole magnetic rings. The braking force may be exerted in each case via a permanently magnetic ring which is arranged on the brake plate and which is fixed relative to the brake plate via a thread. The forces of attraction of opposite-pole permanent magnets depend on the distance between the two permanently magnetic rings, there being an approximately square relation between the magnitude of the force of attraction and the distance. The braking force may thereby be set appropriately for the particular purpose. However, the disadvantage of this arrangement and design of brake plates having opposite-pole magnetic rings is that it is not properly possible to operate the yarn brake independently of position, and that sensitive adjustability of the braking force from zero up to the full locking of the brake is made difficult.

Furthermore, the older application DE 44 09 450 A1 disclosed a generic yarn brake, in which additional axially polarized magnets are provided on the bearing shaft in order to assist the centring of the brake plates. The magnets are polarized in such a way that they axially repell the brake plate located in front of them in each case. At least one of the additional magnets is arranged axially adjustably on the bearing shaft.

The yarn brakes known from the prior art described above have in common the fact that relatively complicated solutions are provided in order to allow self-cleaning and, at the same time, sufficient fine adjustment of the braking force to achieve a high degree of operating reliability.

SUMMARY OF THE INVENTION

The object on which the invention, therefore, to provide a yarn brake of the type mentioned in the introduction, in which the rotatability of at least one or of both brake plates for self-cleaning is achieved and maintained in a simple and cost-effective way and sensitive adjustability of the braking force and universal use in any installation position and for different textile yarns in textile machines become possible.

A yarn brake comprising a first and a second disc- or plate-shaped brake elements between which at least one yarn to be braked can be led through a first magnetic loading device, a second magnetic loading device that is adjustable, a bearing shaft on which said first and second brake elements are mounted to rotate freely about said bearing shaft, a stop arranged separately from said brake elements, a cover receiving said second magnetic loading device arranged on said second brake element, and an adjusting unit.

The first and second brake elements are pressed in resiliently against one another by the first and second magnetic loading devices. The first magnetic loading device is located on only one of the first and second brake elements. The second magnetic loading device is arranged separately from the first and second brake elements in such a way to press one of the first and second brake elements against the stop, and the adjusting unit adjusts the force of the first and second magnetic loading devices to adjust the press of the second brake element against the first brake element.

The separate or contactless arrangement of the loading elements makes it possible to provide a yarn brake which has two brake elements pressed resiliently against one another by loading means and in which the brake elements can be freely movable on the bearing shaft. At the same time, the brake plate provided with the loading means is pressed against the opposite brake plate which bears on a stop and which, on account of the higher bearing friction, is consequently braked to a slightly greater extent than the brake plate having the loading means. At least a minimal difference in the circumferential speeds of the brake plates can be brought about thereby. By virtue of these influences, which may occur both individually and cumulatively, a high self-cleaning effect can be achieved.

By varying the distance between the two mutually repelling loading means, the axial force of the brake elements can be adjusted, since there is a square relation between the magnitude of the force of repulsion and the distance.

This arrangement has, furthermore, the advantage that it can be used irrespectively of the installation position. Furthermore, adjustability is provided over a larger range and while the yarn is running.

BRIEF DESCRIPTION OF THE DRAWINGS

Advantageous developments of the yarn brake according to the invention are described in the following detailed description. Preferred embodiments of the yarn brake according to the invention are explained in more detail in the description of the Figures of which.

DETAILED DESCRIPTION OF PREFERRED EMBODIMENTS

Figure 1:
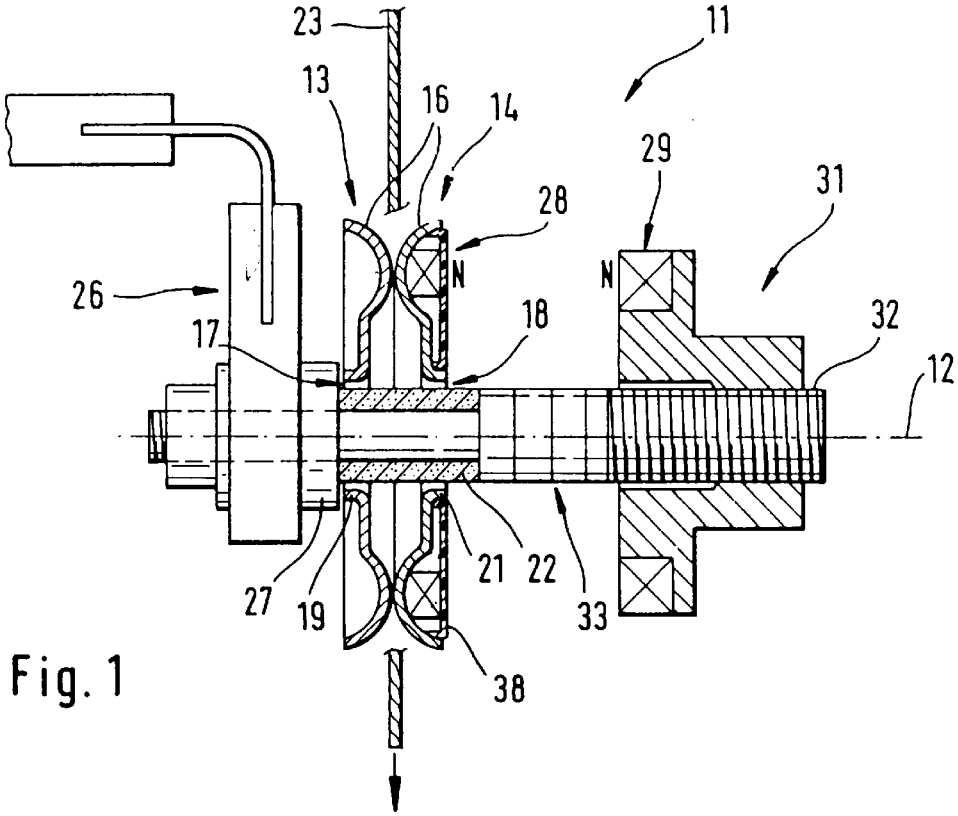
FIG. 1 shows a diagrammatic side view of a yarn brake according to the invention with mutually repelling loading means.

FIG. 1 illustrates a yarn brake 11 according to the invention. This has a bearing shaft 12, of which the installation position, for example in a horizontal orientation, is illustrated, but may be selectable as desired. A first brake element 13 is mounted freely rotatably with play and a second brake element 14 is mounted freely rotatably on this bearing shaft 12. The brake elements 13, 14 are of disc-shaped or plate-shaped design and have a central orifice 17, 18, the said orifices serving for mounting the brake elements 13, 14 on the bearing shaft 12. The brake elements 13, 14 are convexly curved in the manner of a torus, as seen in cross-section, and bear on one another in the region of the convex curvature 16.

Bearing elements 19, 21 for the friction-reducing and/or wear-reducing reception of the brake elements 13, 14 on the bearing shaft 12 are provided in the bearing orifices 17, 18 of the brake elements 13, 14. These bearing elements 19, 21 may be designed as bearing bushes or bearing rings. These bearing elements 19, 21 are advantageously produced from plastic which has good sliding properties along with high wear resistance.

In the bearing or effective region of the brake elements 13, 14, the bearing shaft 12 advantageously has a bearing sleeve 22 which is produced from a hard and wear-resistant material, such as, for example, ceramic. This affords a high stability of the bearing shaft 12 with regard to the brake elements 13, 14 rotating freely on it and to a yarn 23 which can be at least partially deflected around the bearing shaft 12.

The bearing shaft 12 is received by the holder 26 which may be provided, for example, on a yarn delivery device (not illustrated). Provided to the right of the holder 26, directly adjacent to the latter, is a stop 27 which is advantageously produced from a wear-resistant plastic having a low coefficient of friction. The first brake element 13 bears with its bearing element 19 on this stop 27 and is limited to the left in its axial direction of movement and at least partially braked.

The second brake element 14 having a loading means 28 is illustrated opposite the first brake element 13. Illustrated at a distance from this second brake element 14 is a further loading means 29 which is received by an adjusting unit 31 and which is fixed relative to the bearing shaft 12. In the exemplary embodiment, the loading means 28, 29 are designed as permanent magnetic rings which, in the embodiment shown in FIG. 1, have a like-pole arrangement, so that a repelling effect is achieved between the two magnets. An axial force of the second brake element 14 is thereby achieved on the first brake element 13 which experiences a counterforce by means of the stop 27, with the result that the braking force is generated between the two brake elements 13, 14. The loading means 28, 29 are arranged on the brake element 14 and the adjusting unit 31 by means of an adhesive bond. Alternatively, the loading means 28, 29 may be arranged non-positively and/or positively.

The adjusting unit 31 is designed as an adjusting nut which receives the magnetic ring 29. This adjusting nut can be adjusted continuously in the axial direction on a thread 32 of the bearing shaft, so that fine adjustment of the braking force becomes possible. As regards the permanent magnets, the relation applicable to the forces of attraction and repulsion is an approximately square relation between the magnitude of the force of attraction and the distance. The axial force and therefore the braking force between the brake elements 13, 14 can thus be adjusted by a greater or lesser advance of the adjusting unit 31. The thread 32 is advantageously designed as a self-locking thread, so that slight displacement due to vibrations caused by the textile machine cannot occur. Alternatively, an adjusting unit 31 can be provided, which is adjustable in steps and which can be set lockably by means of predetermined distances.

Furthermore, markings 33 may be provided on the bearing shaft 12, and the said markings may be provided, for example, by means of worked-in grooves or colour strips or the like, in order to allow the braking force of the brake elements 13, 14 to be preset. Furthermore, there may be the possibility that, depending on the yarns to be processed, a different braking force is necessary, which can be set quickly by virtue of the markings 33, so that there can be fast resetting times.

The bearing shaft 12 is advantageously produced from non-magnetic material, so that a magnetic flux is ruled out between the loading means 28, 29 and the bearing shaft 12. The force effect of the loading means 28, 29 can be improved markedly thereby. It is perfectly possible, however, that the bearing shaft 12 can also be produced from ferromagnetic material, as stated below.

The brake elements 13, 14 are advantageously produced from ceramic or aluminium with a hard layer or preferably from non-magnetic steel. However, as already mentioned with regard to the design of the bearing shaft 12, there may be provision for producing the brake plates 13, 14 from steel. There may also be provision for designing the brake element 14 as a one-part magnetic component with the loading means 28 which, together with a non-magnetic brake element 13, forms part of the yarn brake 11.

In order to prevent deposits of fluff, a cover 38 is advantageously provided on the second brake element 14. This cover 38 is arranged positively and/or non-positively on the brake element 14. This cover 38 may also fix the loading element 28 relative to the brake element 14, without a further connection- being necessary for this purpose. The cover may be capable of being fastened to the brake element 14 by means of a locking/snap or clamping connection. Alternatively, an adhesive bond may also be provided. The cover 38 is preferably designed as an injection moulding. A cover 38 of this type may also be provided on the adjusting unit 31 and on the brake element 13.

In this exemplary embodiment, the bearing shaft 12 is received by a resiliently elastic holder 26, via which the natural oscillation frequency of the textile machine can be transmitted to the bearing shaft 12. It may thereby become possible, on the one hand, for deposits of fluff to be shaken off. On the other hand, the oscillation frequency can be transmitted to the brake elements 13, 14 and thus make it possible for the self-cleaning effect to be capable of being increased in a simple way. Alternatively, the bearing shaft 12 may be produced, at least in portions, from resiliently elastic material, such as, for example, plastic, and, in the case of a fixed holder 26, be capable of being fastened relative to the holder 26 via an elastomeric bearing, in order to utilize the oscillation of the textile machine.

The design according to the invention of a yarn brake 11 makes it possible to have an arrangement independent of position and can therefore be used for different yarns and textile filaments in different textile-processing machines.

Figure 2:
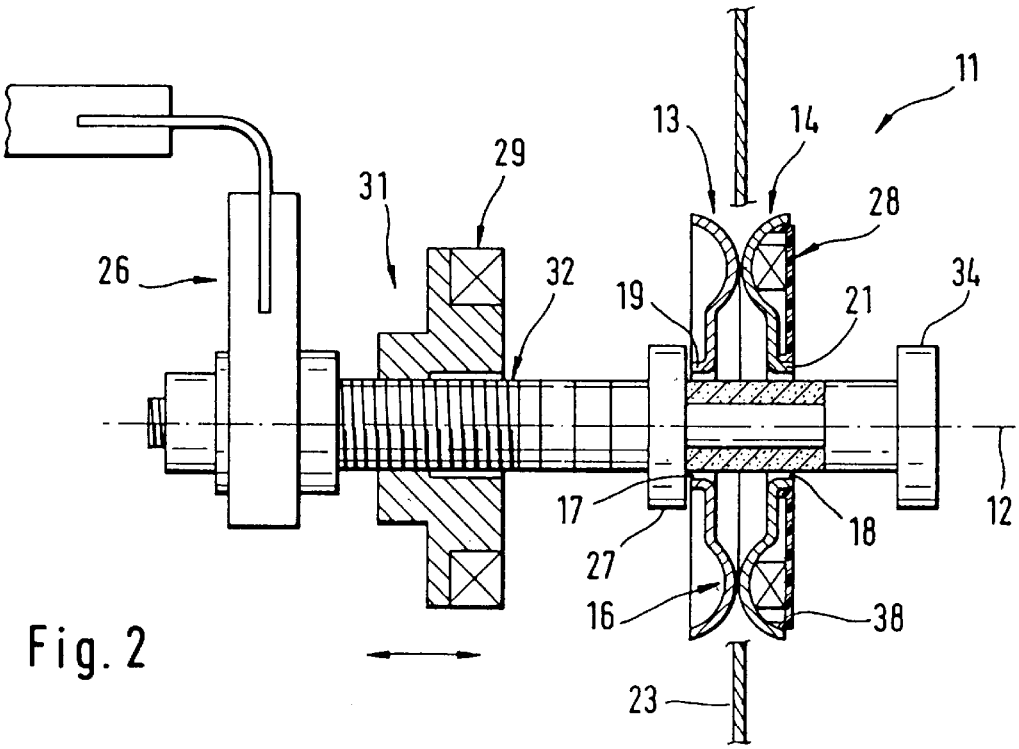
FIG. 2 shows a diagrammatic side view of a yarn brake according to the invention with mutually attracting loading means.

FIG. 2 illustrates an alternative embodiment of the yarn brake 11 according to the invention to that of FIG. 1. In this embodiment, the loading means 28, 29 are in an opposite-pole arrangement, so that they have an attracting effect. In order that a braking force can be generated between the brake elements 13, 14, the first brake element 13 once again bears on a stop 27 and is limited in the axial direction of movement to the left. By virtue of the attracting magnetic effect of the loading means 28, 29, the second brake element 14 is pressed with its loading means 28 against the first brake element 13.

The thread 32, on which the adjusting unit 31 is arranged movably along the longitudinal shaft 12, is advantageously provided between the stop 27 and the holder 26. Opposite the thread 32, the bearing shaft 12 has a collar 34, so that the brake elements 13, 14 are secured on both sides in the axial direction. This collar 34 may directly adjoin the bearing sleeve 22. However, a minimum distance is necessary between the stop 27 and the collar 34, so that the free rotatability of the brake elements 13, 14 about the longitudinal shaft 12 is afforded, without the possibility of friction impeding free rotatability.

Alternatively, there may be provision for arranging the holder 26 between the adjusting unit 31 and the stop 27. The advantage of this is that the yarn brake is arranged nearer to the holder 26. This is advantageous particularly when already existing yarn delivery devices having yarn brakes known from the prior art are retrofitted with the yarn brake according to the invention. As a result, an exchange of the bearing shaft 12 and at least of the second brake element 14 having the loading means 28 and of the additional arrangement of the adjusting unit 31 having loading means 29 makes it possible to provide a yarn brake 11 which does not require any change in the guidance of the yarn.

Apart from this the statements made with regard to FIG. 1 also apply.

Figure 3:
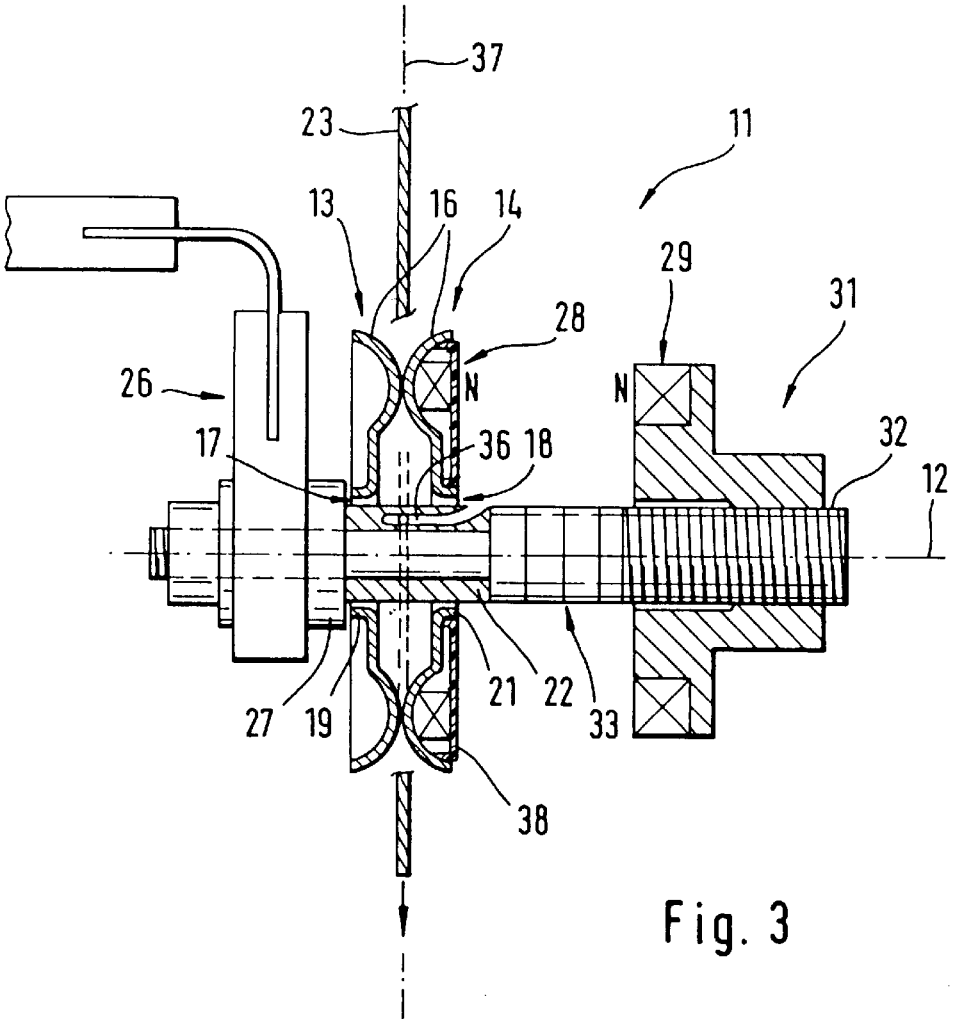
FIG. 3 shows a diagrammatic side view of the yarn brake according to FIG. 1 with a yarn guide slot.

FIG. 3 illustrates a development according to FIG. 1. The bearing shaft 12 has a yarn guide slot 36 which runs essentially off-centre and which extends until it reaches beyond the region of the lead 37 of the yarn through the yarn brake 11. It is thereby possible to ensure that the yarn can also be braked without being deflected, and escape from the yarn brake can be avoided. The yarn guide slot 36 may extend essentially axis-parallel or at an oblique angle from a region laterally outside the brake elements into the region of the yarn lead-through 37. Furthermore, bearing sleeves 22 may be provided, which have the yarn guide slot 36 described above.

Alternatively to the yarn guide slot, two guide pins may also be provided outside the yarn brake, the said guide pins being offset in parallel relative to the bearing shaft, so that the yarn bears reliably on the bearing shaft and is guided.

Figure 4:
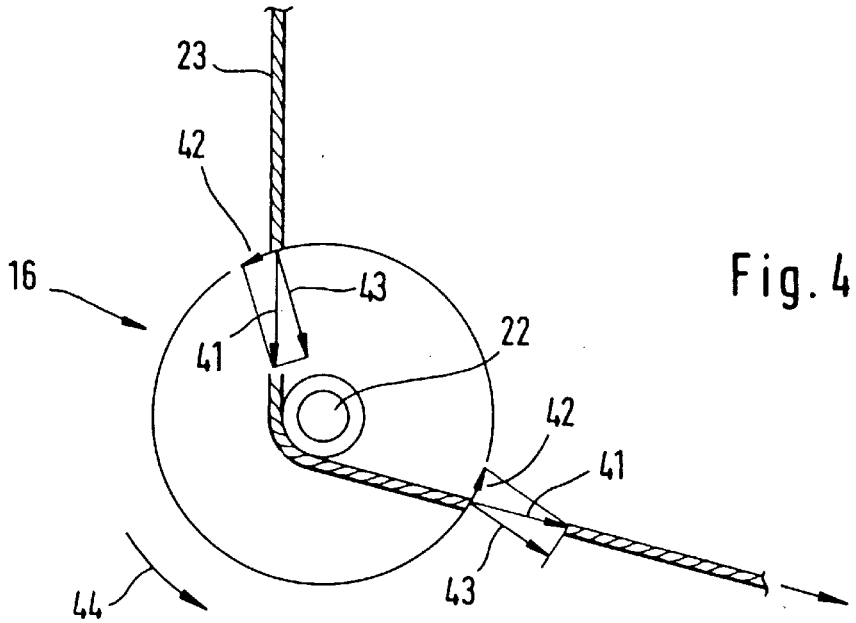
FIG. 4 shows a diagrammatic side view of a brake element together with a force diagram of the forces transmitted to the brake elements via the yarn.

FIG. 4 illustrates a diagrammatic side view of one of the brake elements 13, 14 together with a yarn 23 which is deflected round a bearing sleeve 22. Transmission of force from the yarn 23 to the brake element 13, 14 takes place in the region of the convex curvature 16 of the brake element 13, 14. The resultant tensile force of the yarn 23 according to the arrow 41 is composed of the force components in a tangential force according to the arrow 42 and a radial force according to the arrow 43. At the entry and exit points of the yarn 23, it can be seen that the tangential forces according to the arrow 42 bring about a rotational movement in the direction of rotation according to the arrow 44. At the same time, this rotational movement is braked as a result of a small amount of sliding friction between the bearing elements 19, 21 of the brake elements 13, 14 and the bearing element 19 and stop 27. This state of equilibrium makes it possible, when the axial pressure changes and consequently the braking force on the yarn 23 changes, for the drive torque and the reaction torque of the mounting to change in the same ratio, so that an essentially constant slow rotational speed of the brake elements 13, 14 is established and the self-cleaning effect is ensured in any designed installation position.

Furthermore, there may alternatively be provision for the possibility of providing a plurality of first and second brake elements 13, 14 assigned to one another on a bearing shaft 12. In this case, it is merely necessary that, for example in the case of both the repelling and the attracting arrangements, the brake element 14 furthest from the stop 27 has a loading means 28.

A further improvement in the self-cleaning effect may be achieved by the bearing orifices 17, 18 of the brake elements 13, 14, the said bearing orifices surrounding the bearing shaft 12 with play, being designed so as to be eccentric by a small amount, with the result that it is possible to achieve non-round running, by means of which yarn abrasion can be removed even more effectively from the inner region between the brake elements 13, 14.

There may be provision, furthermore, for the adjusting unit 31 to have means, via which motor-controlled adjustment becomes possible. This may be carried out, for example, by using a long toothed belt which can engage on the adjusting unit or adjusting units 31 and can thus readjust one or more adjusting units 31 simultaneously.

A further advantage of the device according to the invention is to allow simple exchangeability of a traditional yarn brake which consists, for example, of two brake elements and of a compression spring with an adjusting nut which are arranged on a bearing shaft For this purpose, it is necessary to use at least one second brake element 14, with the loading means 28 arranged on it, and one adjusting unit 31 with loading means 29. The first brake element 13 already present may continue to be used. An existing bearing shaft made of ferromagnetic material may, in principle, also continue to be used. In this case, however, it is necessary, when a non-magnetic bearing shaft 12 is used, to set a greater advance of the adjusting unit 31 relative to the second brake element 14, in order to apply the same braking force, since a secondary magnetic flux flows via the bearing shaft 12.

Advantageously, however, there is provision for installing the bearing shaft 12, the brake elements 13, 14 and the adjusting unit 31 on the holder 26 when the yarn brake is being exchanged.

The yarn brake according to the invention may equally be capable of being used in the case of bobbin creels for beaming and warping systems, also known as beaming creels.

I claim:

1. A yarn brake comprising:

a first and a second disc- or plate-shaped brake element between which at least one yarn to be braked can be led through, a first magnetic loading device, a second magnetic loading device that is arranged on said second brake element, a bearing shaft on which said first and second brake elements are mounted to rotate freely about said bearing shaft, a stop arranged separately from said first and second brake elements, an adjusting unit, and at least one cover receiving said second magnetic loading device arranged on said second brake element and said adjusting unit, in which:

said first and second brake elements are pressed resiliently against one another by said first and second magnetic loading devices, said first magnetic loading, device is arranged separately from said first and second brake elements in such a way as to press one of said first and second brake elements against said stop, and said adjusting unit adjusts the magnetic effect of said first and second magnetic loading devices to adjust the press of said second brake element against said first brake element.

2. The yarn brake according to claim 1, in which:

said first and second magnetic loading devices are located opposite each other and press said first and second brake elements against one another by a repelling magnetic effect of said first and second magnetic loading devices.

3. The yarn brake according to claim 1, in which:

said first brake element is arranged between said second brake element and said first magnetic loading device so that said first and second brake elements are pressed against one another by magnetic attraction of said first and second magnetic loading devices.

4. The yarn brake according to claim 1, in which said second brake element is made of non-magnetic material.

5. The yarn brake according to claim 1, in which said adjusting unit is arranged on said bearing shaft and can be adjusted continuously in the axial direction of said bearing shaft.

6. The yarn brake according to claim 1, in which said adjusting unit comprises an adjusting nut.

7. The yarn brake according to claim 6, in which said adjusting nut is arranged on a self-locking thread on said bearing shaft.

8. The yarn brake according to claim 1, in which said adjusting unit is displaceable on said bearing shaft at predetermined distances.

9. The yarn brake according to claim 1, in which at east one of said first and second magnetic loading devices comprises a magnetic ring.

10. The yarn brake according to claim 1, in which at least one of said first and second magnetic loading devices comprises at least one magnetic segment.

11. The yarn brake according to claim 1, in which said second magnetic loading device is arranged positively or non-positively on said second brake element.

12. The yarn brake according to claim 1, in which said first magnetic loading device is arranged positively or non-positively on said adjusting unit.

13. The yarn brake according to claim 1, in which said cover is made of plastic.

14. The yarn brake according to claim 1, in which said second brake element and said second magnetic loading device comprise a replacement part that is arranged to be mounted interchangeably on said bearing shaft.

15. The yarn brake according to claim 1, in which said first magnetic loading device and said adjusting unit comprise a replacement part that is arranged to be mounted interchangeably on said bearing shaft.

* * * * *